US011179023B2

(12) United States Patent
Kim et al.

(10) Patent No.: US 11,179,023 B2
(45) Date of Patent: Nov. 23, 2021

(54) RACK FOR DISHWASHER, DISHWASHER HAVING THE SAME AND MANUFACTURING METHOD THEREOF

(71) Applicant: LG Electronics Inc., Seoul (KR)

(72) Inventors: Minchul Kim, Seoul (KR); Hyoseong Gwag, Seoul (KR); Wonsam Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/552,334

(22) Filed: Aug. 27, 2019

(65) Prior Publication Data

US 2020/0069148 A1 Mar. 5, 2020

(30) Foreign Application Priority Data

Aug. 28, 2018 (KR) ..... 10-2018-0101533

(51) Int. Cl.
*A47L 15/50* (2006.01)

(52) U.S. Cl.
CPC ..... *A47L 15/507* (2013.01); *A47L 15/501* (2013.01); *A47L 15/505* (2013.01)

(58) Field of Classification Search
CPC .... A47L 15/501; A47L 15/505; A47L 15/507; A47L 15/50
See application file for complete search history.

(56) References Cited

U.S. PATENT DOCUMENTS

| | | | | |
|---|---|---|---|---|
| 5,882,739 | A | 3/1999 | Kobos et al. | |
| 2002/0163285 | A1* | 11/2002 | Vanlandingham | A47L 15/50 312/311 |
| 2011/0236698 | A1* | 9/2011 | Filou | C09D 5/032 428/457 |
| 2016/0096196 | A1* | 4/2016 | Papke | C09D 159/04 524/432 |
| 2016/0096971 | A1* | 4/2016 | Papke | C09D 175/06 428/412 |

FOREIGN PATENT DOCUMENTS

| | | |
|---|---|---|
| EP | 0990414 | 4/2000 |
| EP | 1097960 | 5/2001 |

OTHER PUBLICATIONS

Extended European Search Report in European Application No. 19193302.7, dated Jan. 27, 2020, 7 pages.

* cited by examiner

*Primary Examiner* — Stanton L Krycinski
(74) *Attorney, Agent, or Firm* — Fish & Richardson P.C.

(57) ABSTRACT

Disclosed are a rack for a dishwasher, a dishwasher having the same and a manufacturing method thereof. The rack for dishwasher includes a rack body that accommodates therein objects to be cleaned and is disposed within a washing space of the dishwasher, and a fluorine-combined layer formed by molecular binding of fluoride onto a surface of parts formed of a plastic member, enabling the wetting property on the surface of plastic member to be increased to enhance the wetting performance, and friction on the motion parts to be reduced.

11 Claims, 15 Drawing Sheets

| | | |
|---|---|---|
| SURFACE ENERGY | < | SURFACE ENERGY |
| CONTACT ANGLE | > | CONTACT ANGLE |
| WETTING PROPERTY | < | WETTING PROPERTY |

RACK FOR DISHWASHER, DISHWASHER HAVING THE SAME AND MANUFACTURING METHOD THEREOF

CROSS-REFERENCE TO RELATED APPLICATION

Pursuant to 35 U.S.C. § 119(a), this application claims the benefit of earlier filing date and right of priority to Korean Application No. 10-2018-0101533, filed on Aug. 28, 2018, the contents of which is incorporated by reference herein in its entirety.

BACKGROUND OF THE INVENTION

1. Field of the Invention

This specification relates to a rack for a dishwasher, and a dishwasher having the same and a manufacturing method thereof.

2. Background of the Invention

As well known, the dishwasher is a device that is used to wash and clean tableware and/or cooking utensils using detergent and washing water.

The dishwasher typically includes a dishwasher body in which a washing space is formed inside, a door that opens and closes the washing space, a rack that is installed in the washing space, a spray arm that sprays washing water into the rack, a heating unit that heats the washing water, a supply pump that supplies washing water to the spray arm, and a drain pump that drains washing water from the pump.

The above washing space is equipped with racks to accommodate washing objects such as tableware or cooking utensils to be washed. The rack is equipped with an upper rack located at an upper inside of the washing space, a lower rack located at a lower inside of the washing space, and a spoon basket disposed within the upper or lower rack. For some dishwashers, top racks are disposed on the top of the upper racks. The racks are made of metal and/or plastic materials.

Meanwhile, the drying performance of dishwashers is one of the performance indicators of dishwashers that users can feel directly.

To improve the drying performance of the dishwasher, methods for promoting air flow using a blower fan, condensation drying and/or rinsing are used, etc.

On the other hand, plastic members are used for components such as racks that are placed inside the dishwasher (washing space) above. However, the surface is cooled relatively quickly because of the lower heat capacity of the plastic member compared to the ceramic and metal members. This results in a lack of heat required for evaporation of water, which reduces the drying performance.

In view of this, some attempts are made to shorten the drying stroke time by increasing hydration of the surfaces of plastic members.

In addition, some attempts are made to enhance the dry performance by applying fluoride coating on the surface of plastic members.

However, when it comes to fluoridation on the surface of conventional plastic member, the problem is that the melting temperature of fluoride is higher than that of plastic members, resulting in difficulty in application to the coating.

In addition, there is a problem with the method of fluoridation on the surface of these conventional plastic members, which is that the amount of fluoride input is relatively high, resulting in an increase in manufacturing costs.

In addition, in the method of fluoridation on the surface of these conventional plastic members, the coating properties make them less productive and difficult to mass produce.

In addition, fluoride is difficult to maintain surface coating due to its low reactivity with the plastic materials. More specifically, when fluoride is coated on a surface of plastic members, gases may exist between the surface of plastic members and the fluoridation layer, and the expansion of gases between the surface of plastic members and the fluoride coating layer during the heating stroke of the dishwasher causes the fluoride layer to swell and eventually the fluoridation layer to detach (drop out) from the surface of the plastic members.

In addition, small, many holes (cavities) or gaps made of plastic materials have a relatively increased surface tension, which makes it easier to increase the residual amount of washing water introduced during washing, and the drying performance may be impaired because it is not easy to evaporate.

In addition, the surface of a operation parts of a plastic member is limited to reducing the surface roughness, and the relative friction may cause the movement not to become smooth and quiet operation to be insufficient.

In addition, there are problems in that residual washing water may remain in the gap between the operating parts of plastic members, and that evaporation is relatively difficult, causing the drying time to be longer.

RELATED ARTS

Patent Publications (PATENT PUBLICATION 1) U.S. Pat. No. 5,882,739 A
(PATENT PUBLICATION 2) EP 0990412 A2

SUMMARY OF THE INVENTION

Therefore, an aspect of the detailed description is to provide a manufacturing method of racks for dishwashers equipped with plastic members that can increase the drying performance by enhancing the wetting properties of the surface of plastic members, dishwashers equipped with the racks for dishwashers, and racks for the dishwashers.

In addition, another aspect of the detailed description is to provide a manufacturing method of the racks for dishwashers equipped with plastic members that can increase the reactivity with fluoride regardless of the shape of the plastic member, dishwashers equipped with the racks for dishwashers and racks for the dishwashers.

In addition, still another aspect of the detailed description is to provide a manufacturing method of racks for dishwashers equipped with plastic members that can reduce friction on surfaces of operating parts made of plastic member, dishwashers equipped with the racks for dishwashers, and racks for the dishwashers.

To accomplish the above objects of the disclosure, there is provided a rack for a dishwasher that accommodates therein washing objects to be washed and is disposed within a washing space of the dishwasher, in which the rack includes a fluorine-combined layer formed by molecular binding of fluoride onto a surface of parts formed of plastic members.

Here, the rack, formed of plastic members, includes a rack body which forms a storage space of the washing object, and the fluorine-combined layer is formed by molecular binding of fluoride onto a surface of the rack body.

In addition, the rack includes a rack body that forms the storage space of the washing object and a handle formed of a plastic member and coupled to the rack body of the rack, and the handle includes a handle body formed of a plastic member, and the fluorine-combined layer is formed by molecular binding of fluoride onto a surface of the rack body.

The rack includes rollers that come into rolling contact with a supporting object, the rollers include a roller body formed of a plastic member, and the fluorine-combined layer is formed by molecular binding of fluoride onto a surface of the roller body.

Meanwhile, according to another aspect of the present disclosure, there is provided a dishwasher including a dishwasher body that forms a washing space inside, a door that opens and closes the washing space, and a rack that accommodates therein a washing object to be washed and is disposed within the washing space, and the fluorine-combined layer is formed by molecular binding of fluoride onto the surface of the parts formed of plastic members.

Here, the rack includes a rack body that forms the storage space of the washing object, and the fluorine-combined layer is formed by molecular binding of fluoride onto a surface of the rack body.

In addition, the rack includes a rack body that forms the storage space of the washing object and a handle formed of a plastic member and coupled to the rack body, and the handle includes a handle body formed of a plastic member, and the fluorine-combined layer is formed by molecular binding of fluoride onto a surface of the handle body.

The interior of the rack body is equipped with a cup rack.

The cup rack includes a cup rack body formed of a plastic member that supports the cup slant, and a fluorine-combined layer formed by molecular binding of fluoride onto a surface of the cup rack body.

Spoon baskets are provided inside the rack body.

The spoon baskets include a spoon basket body formed of a plastic member and forms an internal storage space therein, and a fluorine-combined layer formed by molecular binding of fluoride onto a surface of the spoon basket body.

The rack includes rollers that come into rolling contact with a supporting object. The rollers include a roller body formed of a plastic member, and a fluorine-combined layer formed by molecular binding fluoride onto a surface of the roller body.

The roller body includes a support shaft hole that accommodates the support shaft therein.

Within the support shaft hole, a fluorine-combined layer is formed.

The rack includes upper and lower racks that are disposed spaced apart from each other at upper and lower portions of the dishwasher body.

The upper rack may include the handle.

In addition, according to another aspect of the present disclosure, there is provided a method for manufacturing racks for dishwashers, contained within a washing space of the dishwasher, that includes parts formed of plastic members and accommodates therein washing objects, including: placing the parts of plastic members inside the chamber, and forming a fluorine-combined layer on a surface of the parts formed of plastic members by molecular bonding of fluoride onto the surface of the parts by injecting fluoride within the chamber.

Here the racks are formed of plastic members and include a rack body forming a storage space of the washing object, and placing the parts formed of plastic member inside the chamber includes placing the rack body inside the chamber.

In addition, the rack includes a rack body that forms the storage space of the washing object; and a handle including a handle body formed of plastic member, coupled to the handle body; and placing the parts formed of plastic member inside the chamber includes placing the rack body and handle body inside the chamber.

The rack includes rollers that come into rolling contact with a supporting object and a support shaft that rotatably supports the rollers; and forming the fluorine-combined layer includes relatively moving the rollers relative to the support shaft.

The relatively moving the rollers against the support shaft includes placing an actuation rod vertically disposed against the support shaft and relatively movable to the rollers so as to be in contact with surfaces of the rollers, and rotating the rollers by reciprocally moving the actuation rod against the rollers.

The rollers include first rollers spaced apart from each other on the same straight line, and second rollers spaced apart from each other by the height difference with the first rollers, and the actuation rod includes a first actuation rod that comes into contact with the first rollers and a second actuation rod that comes into contact with the second rollers, and the first and second actuation rods are configured to reciprocally move at the same time.

The relatively moving the rollers against the support shaft includes placing the rollers on the top of a support in contact with the rollers; and reciprocally moving the support shaft to move the rollers on the support in a rolling manner.

The relatively moving the rollers against the support shaft includes placing the rollers above the top of the support in contact with the rollers, and swing the support.

As described hereinabove, according to one aspect of the present disclosure, it is possible to increase the wetting property on a surface of a plastic member by forming a fluorine-combined layer formed by molecular binding of fluoride onto the surface of the plastic member and increasing the surface energy of the plastic member by the higher activation energy of fluoride.

Thus, it is possible to enhance the drying performance by reducing the amount of residual water on the surface of the plastic member.

In particular, the small and plural number of holes formed on the rack formed of plastic member or residual water in the gap can be significantly reduced, resulting in enhancing the drying performance.

In addition, since molecular binding of fluoride is executed onto the plastic member, fluoride can be more reactive regardless of the shape of the plastic member, resulting in improving the durability of the surface treatment layer (fluorine-combined layer) on the surface of the plastic member.

In addition, since molecular binding of fluoride is executed onto the plastic member, the consumption of fluoride can be significantly reduced and the manufacturing cost can also be reduced. As a result, mass production is possible and productivity can be improved.

In addition, since molecular binding of fluoride is executed onto the surface of the plastic member, friction on the surfaces of the operating parts (internal and/or external) can be significantly reduced.

In addition, the residual amount of water between the surfaces of the operating parts (internal and/or external) can be reduced to enhance the drying performance.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
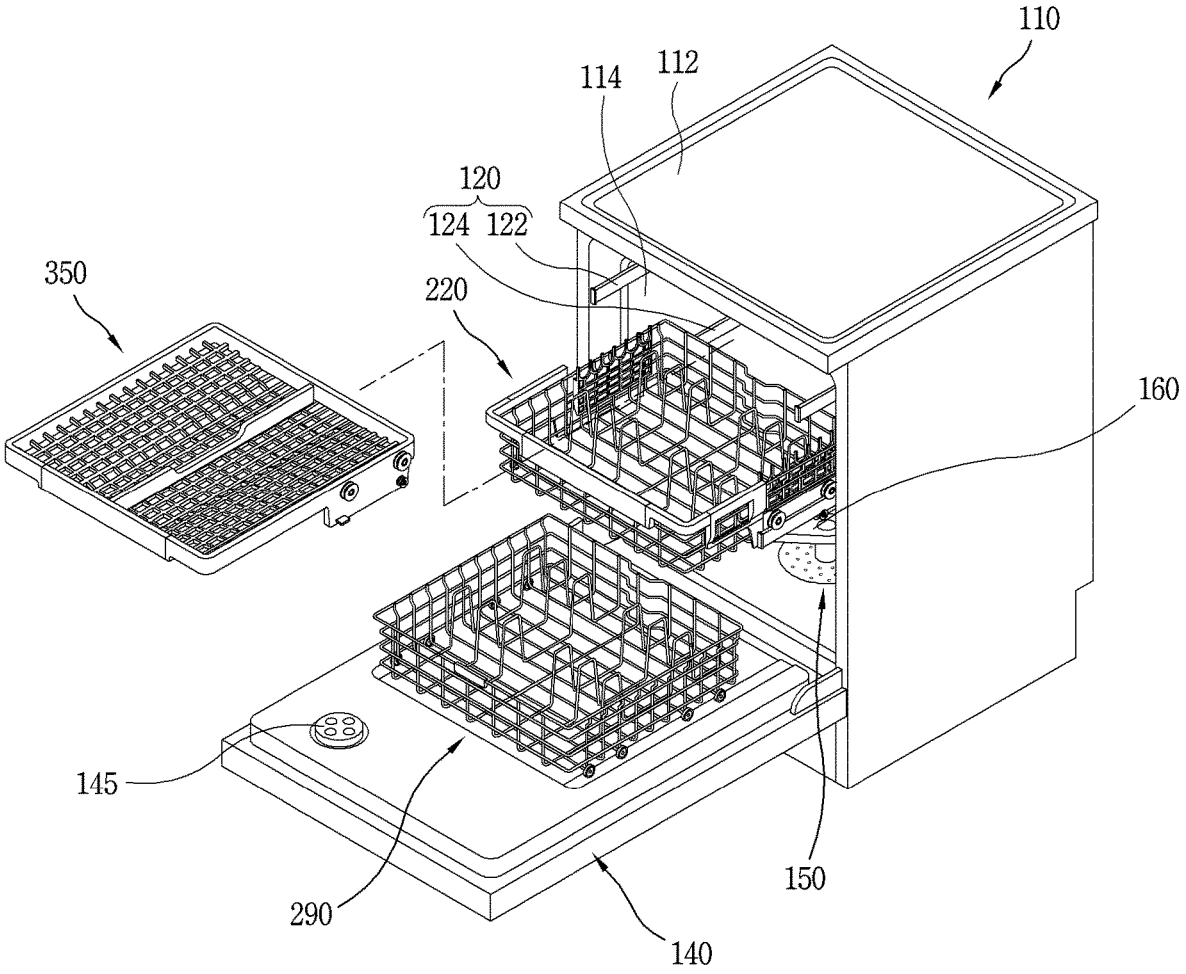
FIG. 1 is a perspective view illustrating a dishwasher in accordance with the present disclosure.

Hereinafter, embodiments of the present disclosure will be described in detail with reference to the accompanying drawings. Herein, like reference numerals denote like elements even in different embodiments, and a description for an element appearing first will replace descriptions for like elements appearing later. As used herein, the singular forms "a," "an," and "the" are intended to include the plural forms as well unless the context clearly indicates otherwise. In describing embodiments disclosed in the specification, moreover, the detailed description will be omitted when a specific description for publicly known technologies to which the invention pertains is judged to obscure the gist of the embodiments disclosed in the specification. Also, it should be noted that the accompanying drawings are merely illustrated to easily understand the embodiments disclosed in the specification, and therefore, they should not be construed to limit the technical spirit disclosed in the specification.

FIG. 1 is a perspective view illustrating a dishwasher in accordance with the present disclosure. As shown in FIG. 1, the dishwasher in accordance with the present disclosure includes a dishwasher body 110, a door, a rack, a sump and a spray arm.

The dishwasher body 110 is substantially formed in a rectangular parallelepiped shape. The dishwasher body 110 includes a cabinet 112 that forms the appearance. The dishwasher body 110 includes a tub 114 that is disposed inside the cabinet 112 and forms a washing space. At the front of the dishwasher body 110, a door 140 is provided. The door 140 is configured to be rotatable in upper and lower directions, with the hinge (not shown) at a lower part. The door 140 may include a discharge hole 145 to allow, for example, air inside the tub 114 to be discharged outward.

The interior of the tub 114 is equipped with a sump 150. The sump 150 is installed in the lower part of the tub 114 so as to contain washing water temporarily. Inside the tub 114, a rack 210 is fitted to accommodate the washing object to be washed. The rack 210 includes, for example, an upper rack 220 and a lower rack 290.

The interior of the washing space may be equipped with a spray arm 160 that sprays washing water. For instance, the spray arm 160 may be positioned to spray washing water into the rack 210. The spray arm 160 may be separated from each other along the upper and lower directions of the washing space. The spray arm 160 may include, though not specifically shown, for example, a top spray arm and an upper spray arm disposed at an upper part and a lower spray arm.

The rack (210) may include, for example, an upper rack 220 and a lower rack 290. The upper rack 220 is disposed at the top of the washing space. The lower rack 290 is disposed at the lower part of the upper rack 220. The rack 210 includes, for example, a top rack 350. The top rack 350 is also referred to as the so-called third rack (hereinafter referred to as the top rack 350) following the upper rack 220 and the lower rack 290. The top rack 350 may be disposed on the top of, for example, the upper rack 220. Here, the top rack 350 is simply named according to its location for the convenience of explanation, and the top rack 350 is a type of a rack for storing slender and long spoons (spoons and chopsticks) and/or cooking utensils. The top rack 350 is exemplary shown to be positioned on the top of the upper rack 220 in this example, but this is only an example, and the top rack 350 may be installed in a different location in the washing space.

Inside the washing space, a rail 120 may be provided to allow the racks 210 to be withdrawn in the front and rear directions. Each of the rails 120 may be disposed in a lengthwise direction on the inside of both side walls of the tub 114. Each of the rails 120 may be formed in the upper area of the washing space. The rail 120 may be provided with a top rail 122, for example, which guides the top rack 350. The rail 120 may be provided with an upper rail 124, for example, which guides the upper rack 220.

Figure 2:
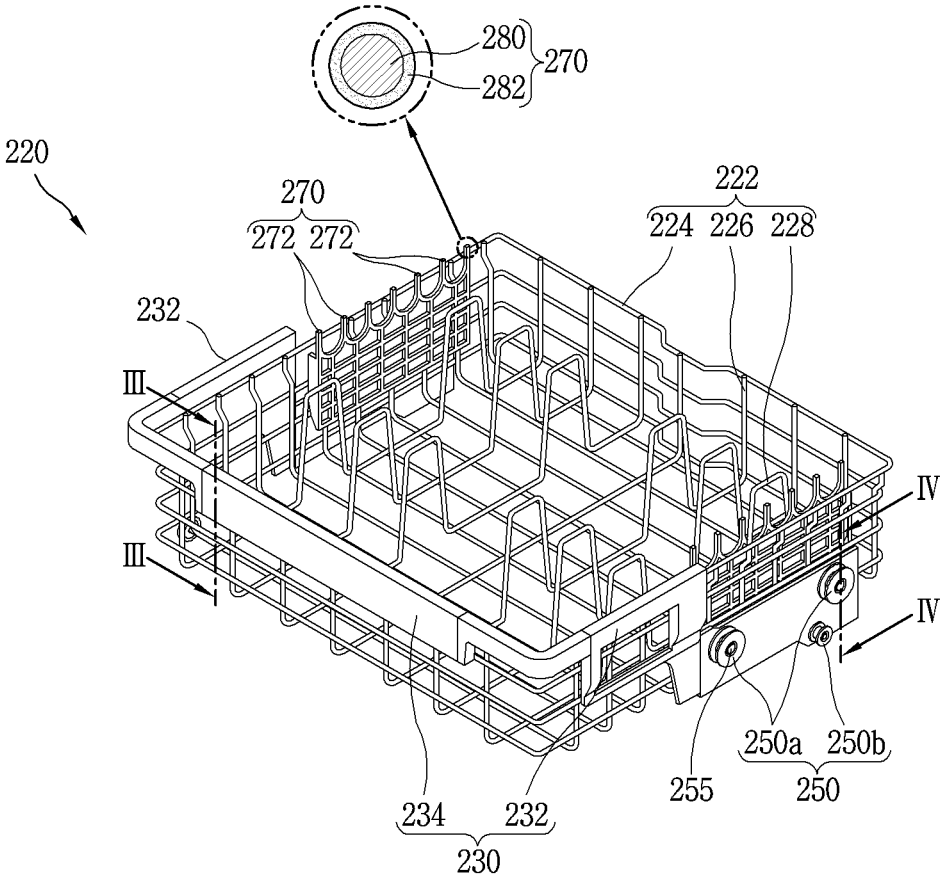
FIG. 2 is a perspective view of an upper rack of FIG. 1.
Figure 3:
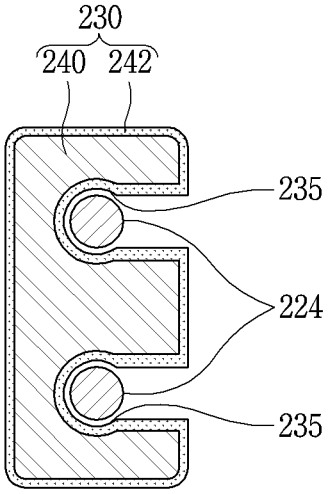
FIG. 3 is a cross-sectional view of essential parts of FIG. 2.

FIG. 2 is a perspective view of an upper rack of FIG. 1, and FIG. 3 is a cross-sectional view of essential parts of FIG. 2.

As shown in FIG. 2, the upper rack 220, for example, includes a rack body 222 that forms a storage space and a handle member 230 coupled to the rack body 222. The rack body 222 may include(or be made of) metal member. The rack body 222 may include, for example, a horizontal frame 224 that is disposed in a horizontal direction and a vertical frame that is disposed in a vertical direction. The rack body 222 may include a plurality of tines 228 to support thin tableware (e.g., dishes) in a standing manner. The plurality of tines 228 may, for example, be implemented in a reverse 'U' shape.

Meanwhile, the handle member 230 of the upper rack 220 may include side handles 232 that are mounted on each side of the upper rack 220 and a front handle 234 that is mounted on the front of the upper rack 220, respectively. The handle member 230 may be formed of a plastic member. The handle member 230 may be coupled around the periphery of, for example, the rack body 222. In this embodiment, the handle member 230 is exemplary shown that it is coupled to outside of the rack body 222, but may also be formed by an insert injection on the outside of the rack body 222. The handle member 230 may include a joint part 235 that is opened on one side to be fitted to the rack body 222. Inside the joint part 235, horizontal frames 224 of the rack body 222 may be inserted and fitted.

The handle member 230 (side handle 232 and front handle 234) may include a handle body 240 formed of a plastic member and a fluorine-combined layer formed by molecular binding of fluoride onto a surface of the handle body 240, as shown in FIG. 3. As a result, the wetness of the surface of the handle member 230 can be increased, allowing the washing water to evaporate rapidly. In addition, the wetness of the joint part 235 of the handle member 230 can be increased, significantly reducing the residual amount of washing water between the handle member 235 and the horizontal frame 224.

Both sides of the upper rack 220 may be equipped with rollers 250 that support the upper rack 220 in a moveable manner. The rollers 250 may be disposed on a supporting object (for instance, upper rail 124) in a rolling contact manner. The rollers 250 may include a support shaft hole 252 through which the support shaft 255 can be inserted. The end of the support shaft 255 may include a fixed member 257 which holds the roller 250 in such a way that the roller 250 does not deviate therefrom. The roller 250 may include a recessed accommodation groove 254 along the radius direction to accommodate therein the supporting object (e.g. upper rail 124). The roller 250 may include, for example, a first roller 250*a* placed on the same line and a second roller 250*b* disposed spaced apart from the first roller 250*a* by a height difference.

Figure 4:
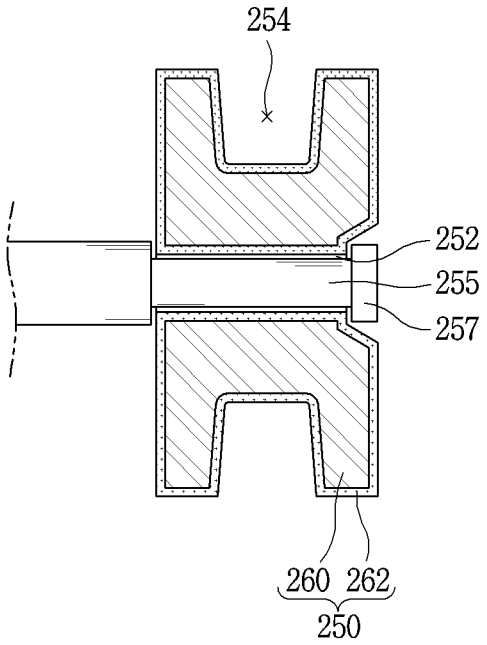
FIG. 4 is a cross-sectional view of a roller region of FIG. 2.

The roller 250 may include a roller body 260 formed of a plastic member and a fluorine-combined layer 262 formed by molecular binding of fluoride onto a surface of the roller body 260, as shown in FIG. 4. As a result, the wetness of the surface of the roller 250 can be increased, allowing the washing water to evaporate rapidly. In addition, the wetness can be increased, significantly, by reducing the residual amount of washing water between the support shaft 255 and the roller 250. In addition, friction on the surface (internal) of the support shaft hole 252 of the roller 250 can be significantly reduced, allowing smooth movement and quiet operation. Further, the residual amount of washing water between the accommodation groove 254 of the roller 250 and the supporting object (e.g. upper rail 124) can be significantly reduced to enhance the drying performance. In addition, friction on the surface of the accommodation groove 254 of the roller 250 can be significantly reduced, allowing smooth movement and quiet operation.

On the other hand, the interior of the upper rack 220 may include a cup rack 270 which receives and supports cups (not shown). The cup rack 270 may be, for example, provided to the upper rack 220 in a detachable manner. The cup rack 270 may include multiple hangers 272, for example, formed so that the opening of the cup can face towards lower side with tilting to one side. Each of the multiple hangers 272 may be formed in a hook shape. The cup rack 270 may be formed of, for example, a plastic member. The cup rack 270 may include, for example, a cup rack body 280 formed of a plastic member and a fluorine-combined layer 282 formed by molecular binding of fluoride on the surface of the cup rack body 280. As a result, the residual amount of washing water between the cup rack 272 and the cups can be reduced to enhance the drying performance.

Figure 5:
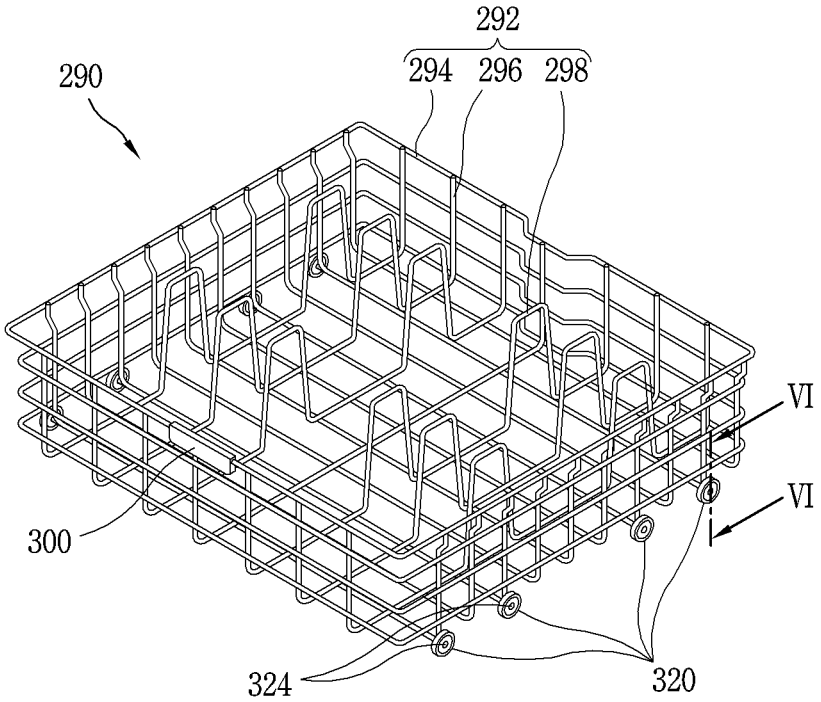
FIG. 5 is a perspective view of an upper rack of FIG. 1.
Figure 6:
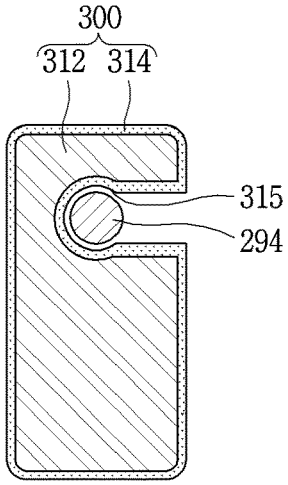
FIG. 6 is a cross-sectional view of a handle member of FIG. 5.
Figure 7:
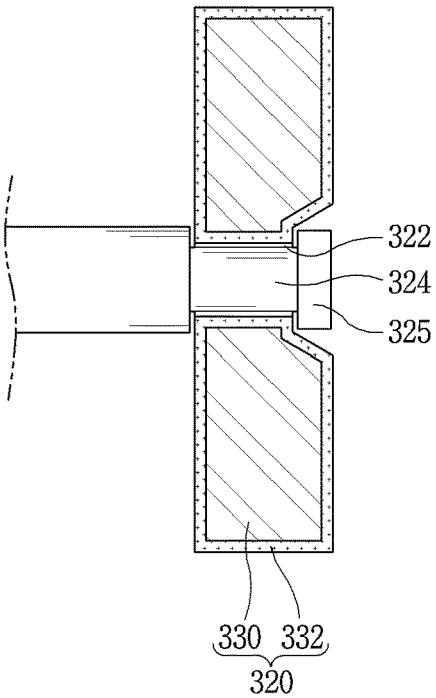
FIG. 7 is a cross-sectional view of a roller region of FIG. 5.

FIG. 5 is a perspective view of an upper rack of FIG. 1, FIG. 6 is a cross-sectional view of a handle member of FIG. 5, and FIG. 7 is a cross-sectional view of roller region of FIG. 5.

As shown in FIG. 5, the lower rack 290 may include a rack body 292 that forms a storage space of washing objects and a handle member 300 included in the rack body 292. The rack body 292 may include (or be made of) metal member. The rack body 292 of the lower rack 290 includes a horizontal frame 294 disposed horizontally and a vertical frame 296 disposed vertically. The rack body 292 may include a plurality of reverse "U" shaped tines 298. The handle member 300 may include a joint part 315 to be coupled with the rack body 292. The joint part 315 may be formed to have an opening at one side. Inside the joint part 315, horizontal frames 294 of the rack body 290 may be inserted and fitted.

As shown in FIG. 6, the handle member 300 may include a handle body 312 formed of a plastic member and a fluorine-combined layer 314 formed by molecular binding of fluoride on the surface of the handle body 312. As a result, the residual amount of washing water on the surface of the handle member 300 can be significantly reduced. The joint part 315 of the handle member 300 can significantly reduce the residual amount of washing water by forming a fluorine-combined layer 314 formed by the molecular-binding of fluoride. As a result, the residual amount of washing water can be significantly reduced in the gap between the joint part 315 and the horizontal frame 294 of the rack body 292, further enhancing the drying performance.

The lower rack 290 may include a plurality of rollers 320 that is in rolling contact with the supporting object. The rollers 320 of the lower rack 290 may be provided on both sides of the lower rack 290. On both side bottoms of the lower racks 290, a support shaft 324 extending horizontally may be formed. The rollers 320 may be provided with a support shaft hole 322 through which the support shaft 324 can be inserted. The end of the support shaft 324 may include a fixed member 325 which holds the roller 320 to inhibit deviation.

The rollers 320 may include a roller body 330 formed of a plastic member and a fluorine-combined layer 332 formed by molecular binding of fluoride on the surface of the roller body 330, as shown in FIG. 7. The fluorine-combined layer 332 may be formed inside the support shaft hole 322 of the roller 320. As a result, the residual amount of washing water can be significantly reduced in the gap between the support shaft hole 322 of the roller 320 and the support shaft 324, thus enhancing the drying performance. In addition, friction within the inner part of the support shaft hole 322 of the roller 320 can be significantly reduced, allowing smooth movement and quiet operation.

Figure 8:
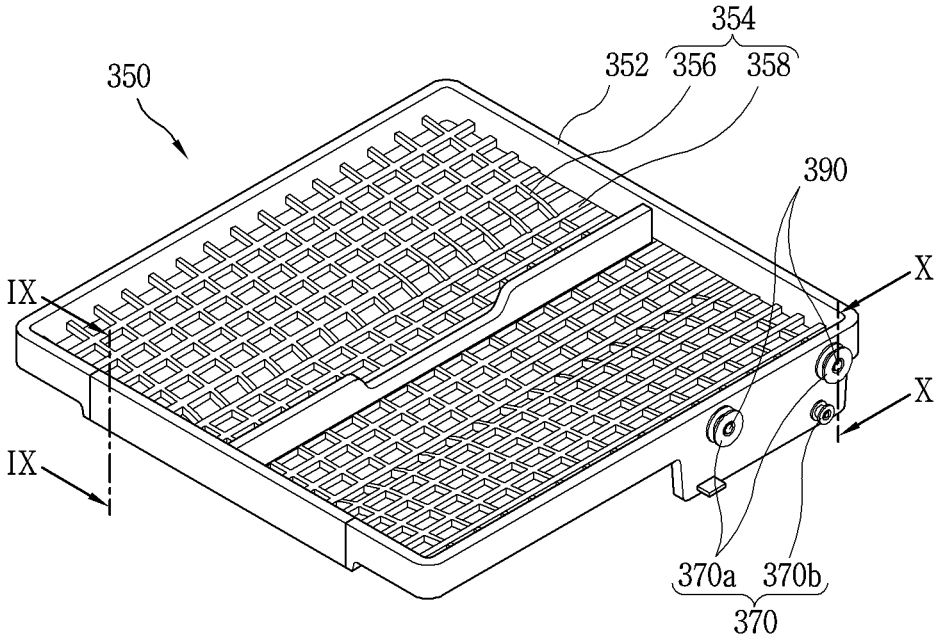
FIG. 8 is a perspective view of a top rack of FIG. 1.
Figure 9:
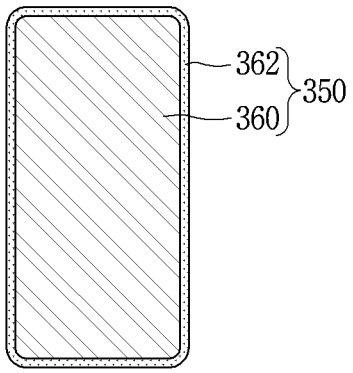
FIG. 9 is a cross-sectional view of essential parts of FIG. 8.
Figure 10:
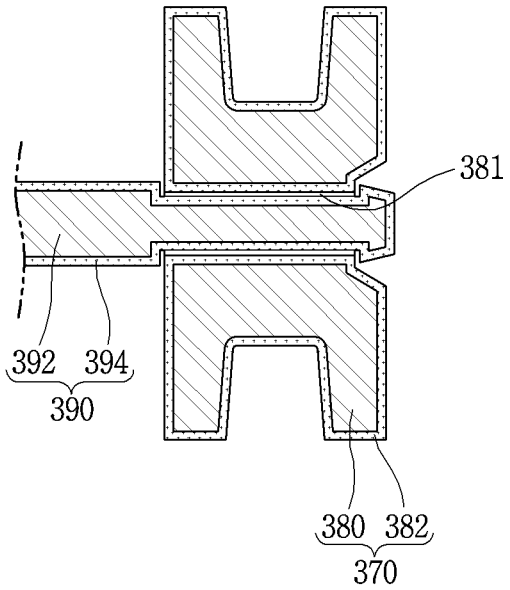
FIG. 10 is a cross-sectional view of a roller region of FIG. 8.

FIG. 8 is a perspective view of a top rack of FIG. 1, FIG. 9 is a cross-sectional view of essential parts of FIG. 8, and FIG. 10 is a cross-sectional view of roller region of FIG. 8.

As shown in FIG. 8, The top rack 350 may be constructed for receiving and cleaning, e.g. thin and long forms of spoons and/or cooking utensils. The top rack 350 may be formed of a plastic member. The top rack 350 may include a rim member 352 of the quadrangular type and a support member 354 mounted inside the rim member 352. The support member 354 may include a transverse frame 356 and a longitudinal frame 358 that are disposed to be intersected with each other. At both sides of the rim member 352, rollers 370 in rolling contact with the supporting object (e.g. Top rail 122) may be provided. The rollers 370 may include a first roller 370*a* placed on the same line and a second roller 370*b* placed with the height difference between the first roller 370*a*.

The top rack 350 may include a top rack body 360 formed of a plastic member and a fluorine-combined layer 362 formed by molecular binding of fluoride on the surface of the top rack body 360, as shown in FIG. 9. As a result, residual amount of washing water can be significantly reduced on the surface of the top rack body 360 to enhance the drying performance. In particular, the residual amount of washing water in the cross-domain of the horizontal frame 356 and the longitudinal frame 358 can be significantly reduced, which can significantly increase the dry performance.

At both sides of the top rack 350, a support shaft 390 is provided to support the rollers 370. The rollers 370 may include a support shaft hole 381 through which the support shaft 390 can be inserted. The support shaft 390 may be formed of a plastic member, for example. The support shaft 390 may include a support shaft body 392 formed of a plastic member and a fluorine-combined layer 394, for example, formed by molecular binding of fluoride on the surface of the support shaft body 392. As a result, friction on the surface (external surface) of the support shaft 390 can be significantly reduced. In addition, the wetness of the surface of the support shaft 390 can be increased, significantly reducing the residual amount of washing water.

The rollers 370 of the top rack 350 may include a roller body 380 formed of a plastic member and a fluoride-combined layer 382 formed by molecular binding of fluoride onto the surface of the roller body 380. Under these configurations, the wetness of the surface of the roller 370 can be increased, significantly reducing the residual amount of washing water on the surface of the roller 370. In addition, friction on the surface of the support shaft hole 381 and the outside of the support shaft 390 can be significantly reduced, allowing smooth movement of the roller 370 and quiet operation. In addition, the residual amount of washing water may be significantly reduced in the gap between the exterior of the support shaft 390 and the inside of the support shaft hole 380. As a result, drying performance can be further enhanced.

Figure 11:
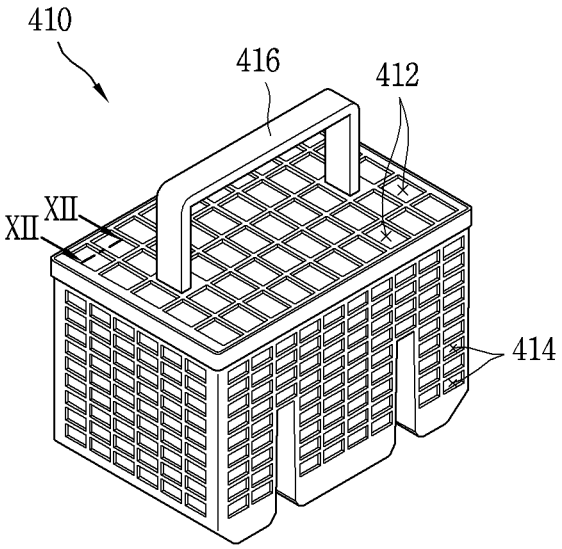
FIG. 11 is a perspective view of a spoon basket of the dishwasher of FIG. 1.
Figure 12:
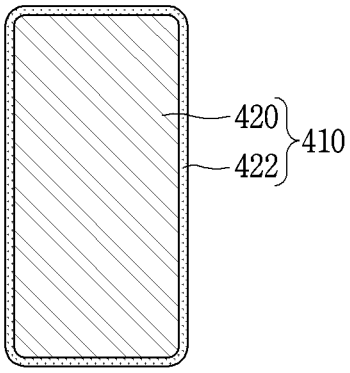
FIG. 12 is a cross-sectional view of essential parts of FIG. 11.

FIG. 11 is a perspective view of a spoon basket of the dishwasher of FIG. 1, and FIG. 12 is a cross-sectional view of essential parts of FIG. 11.

As shown in FIG. 11, a spoon basket 410 is a type of rack that can clean by storing and washing objects to be washed, e.g. slender long spoons, forks, chopsticks, etc. The spoon basket 410 may be referred to as a spoon rack (hereinafter, referred to as spoon basket 410) in that it functions to store and support spoons for cleaning. The spoon basket 410 may include multiple cells 412 that are divided to separately store washing objects, e.g. spoons, forks, chopsticks, etc. A handle 416 may protrude on the top of the spoon basket 410. Multiple perforations 414 may be formed on the side of the spoon basket 410. The lower part of the above spoon baskets 410 may include relatively small perforations (not shown) so that relatively small washing objects, such as chopsticks, can be supported without falling down to the bottom.

The spoon basket 410 may include a spoon basket body 420 formed of a plastic member and a fluorine-combined layer 422 formed by molecular binding of fluoride onto the surface of the spoon basket body 420, as shown in FIG. 12. Under these configurations, the wetness of the surfaces of each cell 412 and each perforation 414 of the spoon basket 410 can be significantly increased, remarkably reducing the residual amount of washing water. As a result, drying performance can be remarkably improved.

Hereinafter, referring to FIGS. 13 to 23, description will be given of a method for manufacturing the rack for a dishwasher in accordance with the present disclosure.

Figure 13:
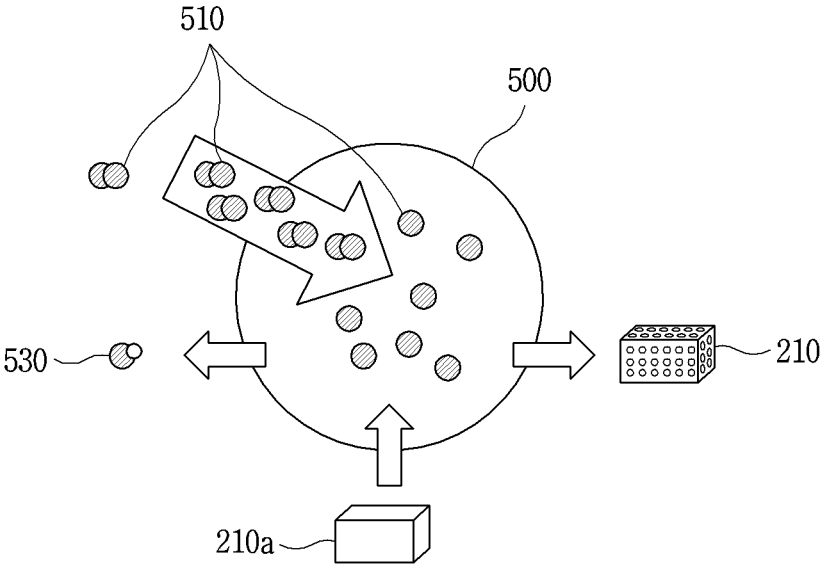
FIG. 13 is a diagram illustrating a fluoridation treatment process for the rack for dishwasher in accordance with one aspect of the present disclosure.
Figure 14:
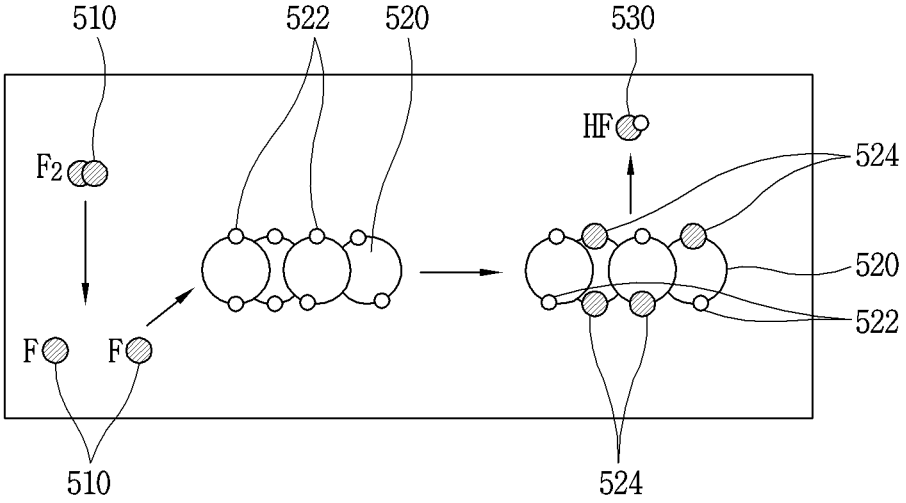
FIG. 14 is a diagram illustrating a molecular binding process of a plastic member and fluoride of FIG. 13.
Figure 15:
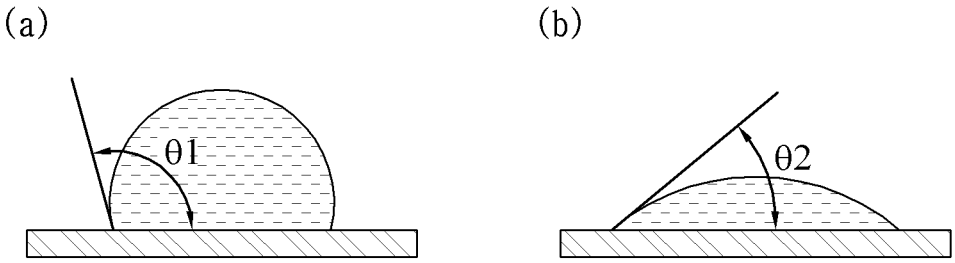
FIG. 15 is a diagram comparatively illustrating a contact angle of a fluorine-combined layer on a plastic member that is fluoridation treated and that of a typical plastic member.
Figure 16:
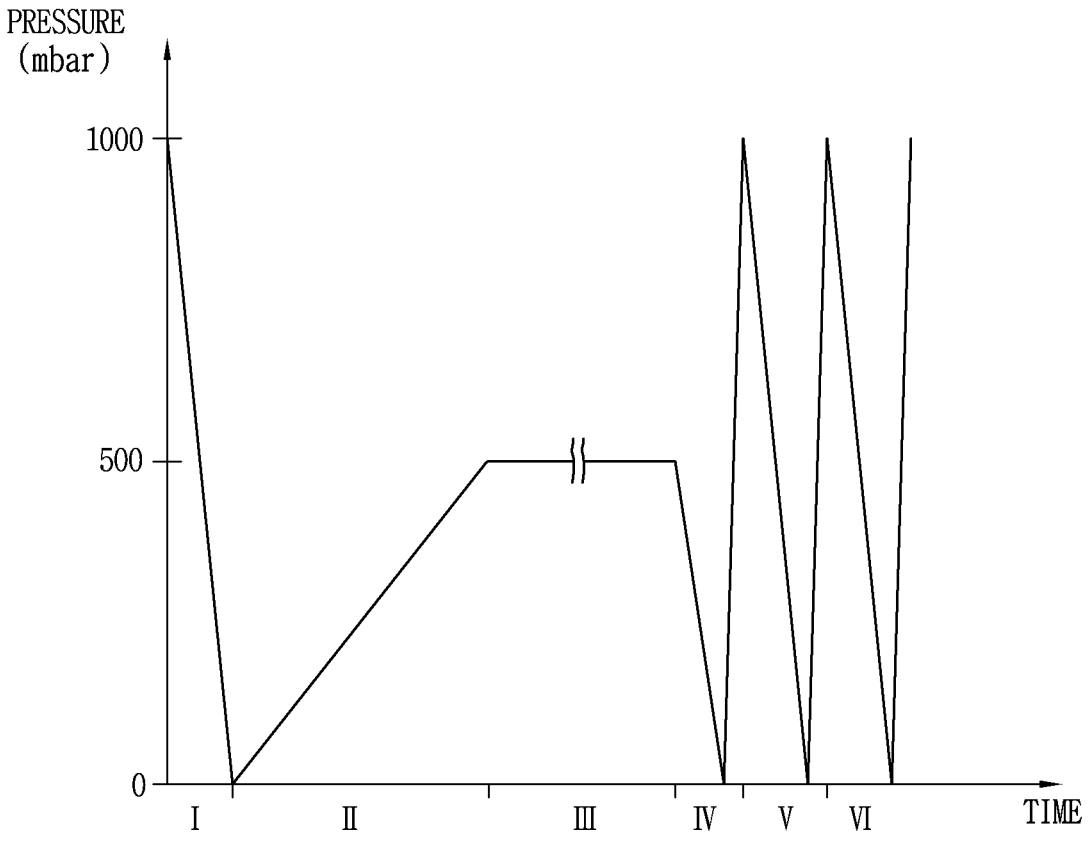
FIG. 16 is a diagram illustrating a pressure change process within a chamber of FIG. 13.

FIG. 13 is a diagram illustrating a fluoridation treatment process for the rack for dishwasher in accordance with one aspect of the present disclosure, FIG. 14 is a diagram illustrating a molecular binding process of a plastic member and fluoride of FIG. 13, FIG. 15 is a diagram comparatively illustrating a contact angle of a fluorine-combined layer on a plastic member that is fluoridation treated and that of a typical plastic member, and FIG. 16 is a diagram illustrating an internal pressure change process within a chamber of FIG. 13.

As shown in FIG. 13, when the rack for a dishwasher is fluoridated, a rack body 210*a* formed of a plastic member or a rack body 210*a* including a handle member formed of a plastic member is placed inside the chamber 500, and fluoride 510 is injected into the chamber 500. When the fluoride is injected into the chamber 500, the fluoride 510 is molecular-bonded onto the surface of the rack body 210*a* made of plastic member, or the handle member of the plastic member, to form a fluorine-combined layer 524.

The fluoride (F) 510 injected inside the chamber 500 is, when hydrogen (H) 522 of the plastic (polymer) that is the material of the rack body or the handle member is decoupled (disassembled), molecular-bound instead on the place where the hydrogen 522 is eliminated, to form the fluorine-combined layer 524. The hydrogen 522 eliminated from the plastic (polymer) 520 will be combined with other fluoride 510 inside the chamber 500 and remain as a residue (HF) 530. The residue 530 may be collected after, for example, non-toxic (neutralized) process. At one side of the chamber 500, a residue neutralization facility (not shown) for the non-toxic neutralization of the residue (HF) 530 may be provided.

Polymers (plastics) 520 combined with the fluoride 510 may increase the surface energy by the action of fluoride 510 with high activation energy, and may increase wetness by the force pulling toward the surface of the polar washing water (water). The contact angle (θ2) of water in the fluorine-combined layer 524 will be relatively small, as will the contact angle of the metal and ceramic water, compared to the contact angle (θ1) of the water in plastic, as shown in FIG. 15. The plastic member having the fluorine-combined layer 524 may reduce the contact angle (θ2) of water by the action of the fluoride 510 and significantly increase surface energy and surface wetness. As a result, drying performance can be improved. In addition, surface friction can be significantly reduced.

The interior of the chamber 500 may undergo a multiple-stage transformation process of a pre-set pattern, for example, as shown in FIG. 16. The transformation process may include a first stage (I) to pressurize the inside of the chamber 500 to a preset primary pressure (e.g. 1000 mbar) and then depressurize, a second stage (II) to slowly pressurize to a secondary pressure (e.g. 500 mbar) that is lower than the primary pressure after the first stage, a third stage (III) to maintain the secondary pressure for a predetermined time after reaching the secondary pressure, a fourth stage (IV) to depressurize at the secondary pressure, and fifth stage (V) and sixth stage (VI) to repeatedly pressurize and depressurize up to the primary pressure at a relatively rapid speed.

Figure 17:
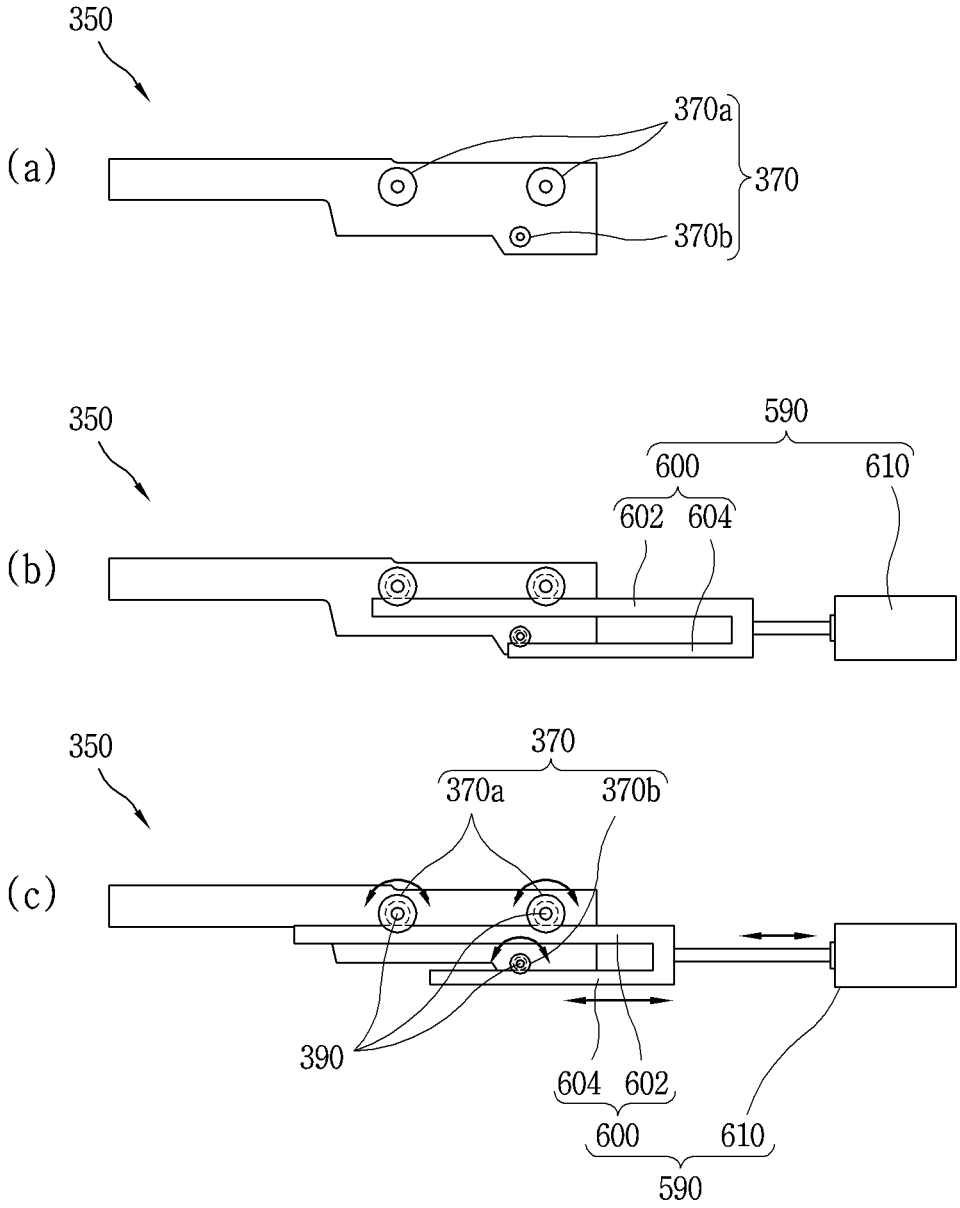
FIG. 17 is a diagram illustrating a process of relative motion of rollers in the fluoridation treatment process of a top rack of FIG. 1.
Figure 18:
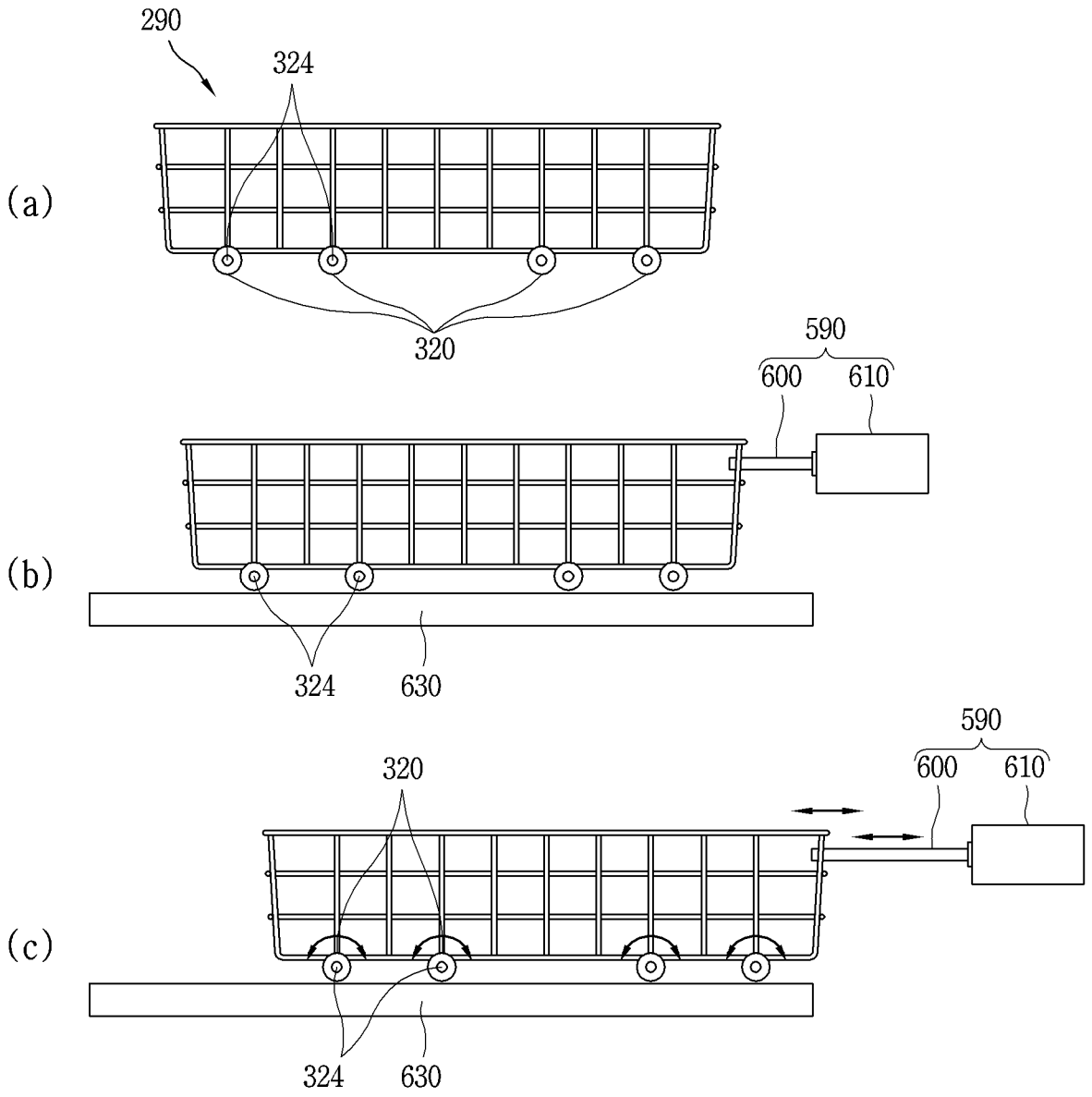
FIG. 18 is a diagram illustrating a process of relative motion of rollers in the fluoridation treatment process of a lower rack of FIG. 1.
Figure 19:
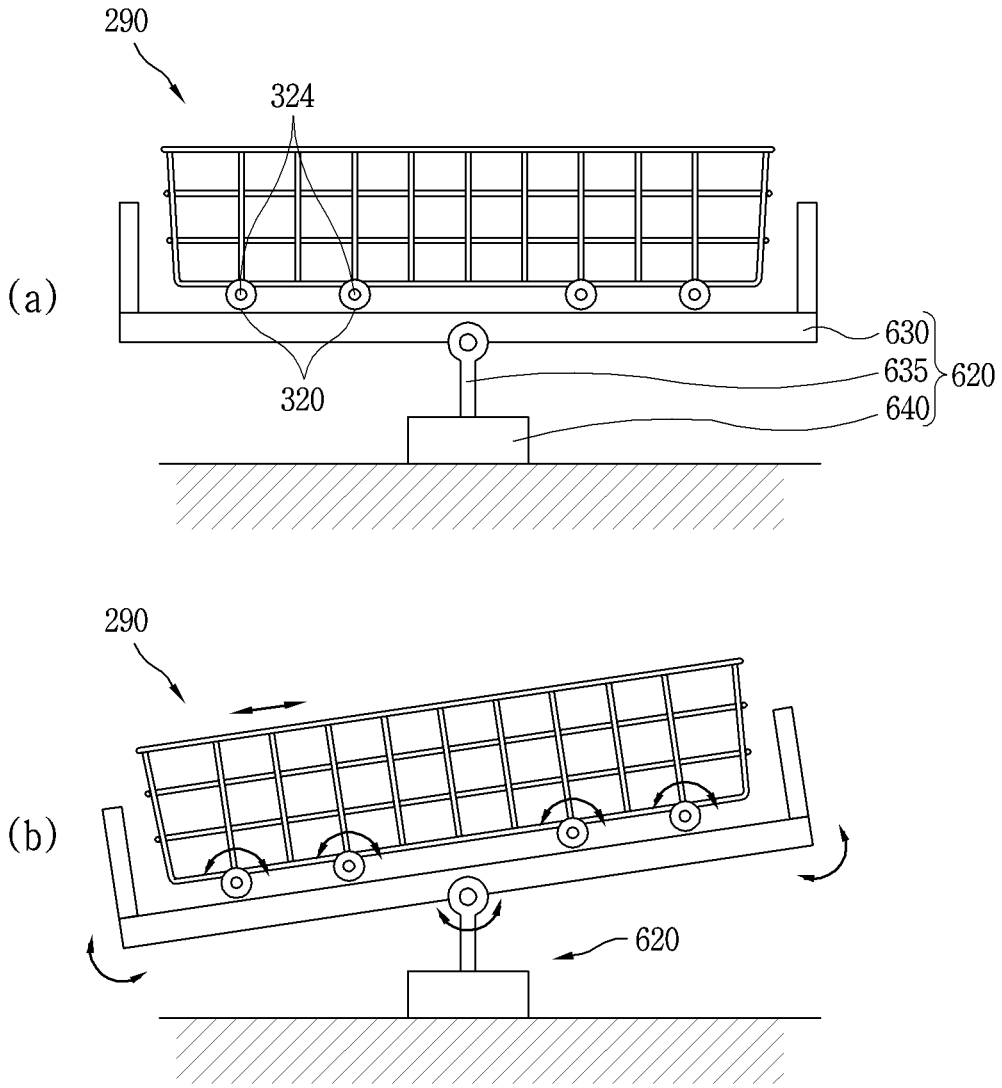
FIG. 19 is a diagram illustrating a process of relative motion of rollers in the fluoridation treatment process of a lower rack of FIG. 1 in accordance with another aspect of the present disclosure.

FIG. 17 is a diagram illustrating a process of relative motion of rollers in the fluorine-treatment process of a top rack of FIG. 1, FIG. 18 is a diagram illustrating a process of relative motion of rollers in the fluorine-treatment process of a lower rack of FIG. 1, and FIG. 19 is a diagram illustrating a process of relative motion of rollers in the fluorine-treatment process of a lower rack of FIG. 1 in accordance with another aspect of the present disclosure.

As shown in FIG. 17, when the top rack 350 is located inside the chamber 500, the roller 370 of the top rack 350 may be movable relative to the support shaft 390.

The interior of the chamber 500 may be equipped with a drive unit 590 including an actuation rod 600 which comes into contact with the roller 370 of the top rack 350 to cause a relative motion of the roller 370. The actuation rod 600 may include a first actuation rod 602 which comes into contact with the first roller 370*a* and a second actuation rod 600 which comes into contact with the second roller 370*b*.

The first actuation rod 602 and the second actuation rod 604 may be integrally connected together. The first and second actuation rods 602 and 604 may be equipped at their one side with an actuator 610 to reciprocally move the first actuation rod 602 and the second actuation rod 604 simultaneously. The actuator 610 may, for example, be an electric motor. This configuration allows the first roller 370*a* and the second roller 370*b* to simultaneously rotate relative to the support shaft 390 when the actuator 610 reciprocates the first actuation rod 602 and second actuation rod 604. As a result, molecular binding of fluoride 510 can be effectively made inside each support shaft hole 381 of the first roller 370*a* and second roller 370*b*. As a result, friction within the inner part of the support shaft hole 381 may be reduced, and residual water of the washing water may be reduced.

Meanwhile, as shown in FIG. 18, the interior of the chamber 500 may be equipped with a support 630 contacting with the roller 320 of the lower rack 290. When the roller 320 of the lower rack 290 is to be rotated relative to the support shaft 324, the lower rack 290 may be moved relative to the support 630. As a result, the molecular binding of fluoride 510 inside the support shaft hole 381 of the roller 320 can be effectively achieved. As a result, friction within the inner part of the support shaft hole 381 may be reduced, and residual water of the washing water may be reduced.

In addition, as shown in FIG. 19, the interior of the chamber 500 may be equipped with a swing motion unit 620 capable of swinging the lower rack 290. The swing unit 620 may include a support 630 that comes into contact with the roller 320 of the lower rack 290 and supports the lower rack 290, a support rod 635 that supports the support 630, and an actuator 640 that operates the support rod 635. According to this configuration, when the actuator 640 drives the support rod 635, the support 630 is moved around the support rod 635 in a swinging manner. Accordingly, the lower rack 290 may be reciprocated on the upper surface of the support 630. When the lower rack 290 is reciprocated over the top surface of the support 630, the roller 320 is rotated relative to the support shaft 324 and the molecular binding of fluoride 510 can be effectively achieved inside the support shaft hole 322 of the rollers 320. As a result, friction within the inside of the support shaft hole 322 may be reduced, and residual water of the washing water may be reduced.

Figure 20:
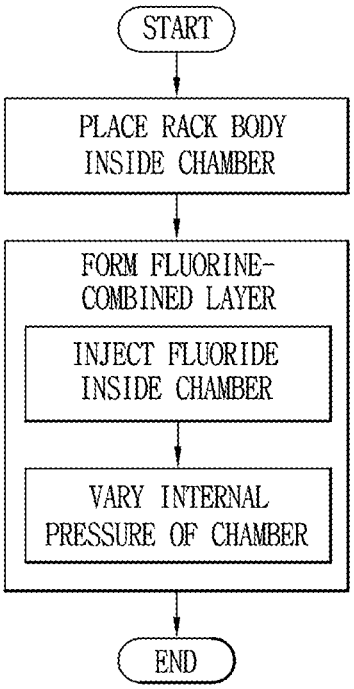
FIG. 20 is a diagram illustrating a manufacturing method of a rack for a dishwasher in accordance with one aspect of the present disclosure.

FIG. 20 is a diagram illustrating a manufacturing method of a rack for a dishwasher in accordance with one aspect of the present disclosure.

As shown in FIG. 20, a method for manufacturing a rack for a dishwasher in accordance with one aspect of the present disclosure is directed to manufacturing the rack 210 including the rack body 210*a* formed of a plastic member placed inside of the washing space of the dishwasher to store washing object to be washed, the manufacturing method includes: placing the rack body 210*a* inside the chamber 500 (S110); and forming a fluorine-combined layer 524 formed by molecular binding of the fluoride 510 onto the surface of the rack body 210*a* (S120).

The step (S120) for forming a fluorine-combined layer 524 on the surface of the rack body includes a step of injecting fluoride 510 into the chamber 500 (S125). The step (S120) for forming a fluorine-combined layer 524 on the surface of the rack body may include a step of varying the internal pressure of the chamber 500 (S135). In the step of varying the internal pressure of the chamber 500, the pressure may be varied to a predetermined patterns (Step I, Step II, Step III, Step IV, Step V, and Step VI), as described with reference to FIG. 16.

By such configurations, fluoride 510 may be molecular-bound onto the surface of the rack body 210*a* made of plastic member, forming a fluorine-combined layer 524. As a result, on the surface of the rack 210 in which the fluorine-combined layer 524 is formed, the residual amount of washing water can be significantly reduced and the drying performance can be remarkably increased by the above action of the fluorine-combined layer 524.

Figure 21:
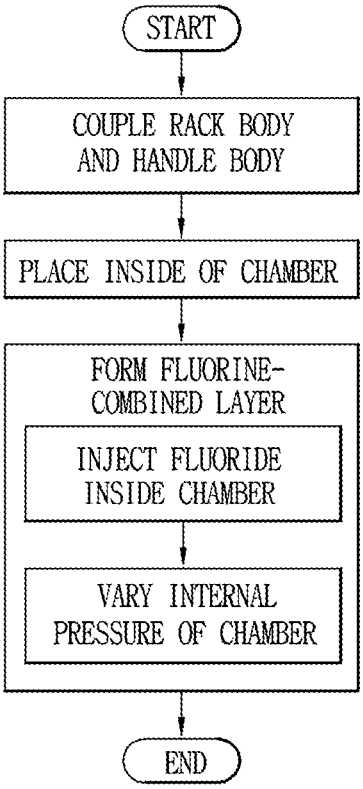
FIG. 21 is a diagram illustrating a manufacturing method of a rack for a dishwasher in accordance with another aspect of the present disclosure.

FIG. 21 is a diagram illustrating a manufacturing method of a rack for a dishwasher in accordance with another aspect of the present disclosure.

As shown in FIG. 21, the manufacturing method of racks for dishwashers in accordance with this aspect of the present disclosure is directed to a method for manufacturing the rack 210 for dishwasher including a rack body 210*a* forming a storage space for washing object and a handle member formed of a plastic member coupled to the rack body 210*a*, includes: coupling the handle body formed of a plastic member to the rack body 210*a* (S210), and placing the assembly of the rack body 210*a* and the handle body to inside of the chamber 500 (S220), and then forming a fluorine-combined layer 524 onto a surface of the handle body (S230).

The step (S230) of forming the fluorine-combined layer 524 on the surface of the handle body formed of the plastic member includes a step of injecting fluoride 510 inside the chamber 500 (S235) and a step of varying the pressure inside the chamber 500 (S245).

Under this configuration, the fluorine-combined layer 524 formed by molecular binding of the fluoride 510 on a surface of the handle member of the rack body 210*a* formed of a plastic member, is provided such that the residual amount of washing water on the surface of the handle member, and the coupling area between the handle body and the rack body 210*a* can be significantly reduced to enhance the drying performance.

Figure 22:
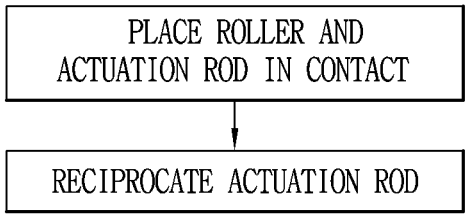
FIGS. 22 through 24 are diagrams illustrating a process of relative motion of rollers under the manufacturing method of a rack for a dishwasher in accordance with other aspects of the present disclosure.
Figure 23:
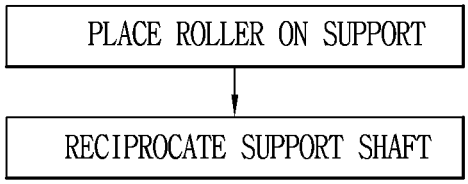
Figure 24:
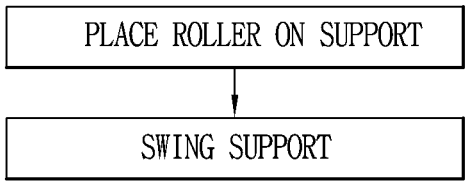

FIGS. 22 through 24 are diagrams illustrating a process of relative motion of rollers under the manufacturing method of a rack for a dishwasher in accordance with other aspects of the present disclosure.

The manufacturing method of the rack 210 for a dishwasher may include a further step of moving the roller relative to the support shaft. As a result, molecular-binding of the fluoride 500 on the inside of the support shaft of the roller can be achieved smoothly, significantly reducing friction inside the support shaft hole of the roller. In addition, the residual amount of washing water can be significantly reduced in the gap between the support shaft hole and the support shaft, thus enhancing the drying performance.

As shown in FIG. 22, the step of moving the rollers relative to the support shaft includes a step of placing the actuation rod, vertically disposed toward the support shaft and relatively movable against the roller, so as to be in contact with the roller (S250), and a step of reciprocally moving the actuation rod against the roller so as to rotate the roller (S260).

Referring back to FIG. 17, the roller 370 of the rack 350 for a dishwasher includes a first roller 370*a* disposed in the same line, and a second roller 370*b* disposed at a height difference with the first roller 370*a*. In the interior of the chamber 500, there is provided a drive unit 590 which operates the roller 370 to move relative to the support shaft 390. The drive unit 590 may include an actuation rod 600 that is reciprocally moved in contact with the roller 370 and an actuator configured to reciprocally move the actuation rod 600. The actuation rod 600 includes a first actuation rod in contact with the first roller 370*a* and a second actuation rod 604 in contact with the second roller 370*b*.

Under this configuration, when the actuator 610 reciprocates the actuation rod 600, the roller 370 contacted by the actuation rod 600 is rotated in normal and reverse directions against the support shaft 390, allowing smooth molecular binding of fluoride 510 into the inside of the support shaft 381. As a result, internal friction of the support shaft hole 381 can be significantly reduced, allowing smooth movement of the rack 210 for a dishwasher and quiet operation. In addition, the residual amount of washing water can be significantly reduced in the gap between the support shaft 390 and the support shaft hole 381, resulting in enhancing the drying performance.

Further, as shown in FIG. 23, the step of rotating the roller relative to the support shaft may include: a step of placing the roller onto the support so as to be in contact with the support (S255); and a step of reciprocally moving the support shaft such that the roller may be movable on the support in a rolling manner (S265)

Referring back to FIG. 18, inside the chamber 500, a support 630 may be provided such that the roller 320 of the rack 290 for a dishwasher may be in contact therewith. Inside the chamber 500, there may be provided a drive unit 590 configured to reciprocally move the rack 290 for a dishwasher in a state that the roller 320 is in contact with the support 630. The drive unit 590 may include an actuation rod connected to the rack 290 for a dishwasher and an actuator 610 configured to reciprocally move the actuation rod 600.

This configuration allows the actuation rod 600 to be connected to the rack 290 for a dishwasher when the roller 320 of the rack for a dishwasher is placed on the support so as to be in contact with the support 630. When the actuator 610 reciprocates the actuation rod 600, the rack 290 for a dishwasher reciprocates on the top of the support 630, and when the support shaft 324 is reciprocated, the roller 320 is rolled on the upper surface of the support 630. Thus, the molecular binding of fluoride 510 is smoothly carried out inside the support shaft hole 322. As a result, friction within the inside of the support shaft hole 322 may be reduced, and residual water of the washing water may be reduced.

Further, as shown in FIG. 24, the step of relative moving the roller against the support shaft may include: a step of placing the roller onto the support so as to be in contact therewith (S256), and a step of swing the support (S266).

Referring back to FIG. 19, inside the chamber 500, a drive unit 620 configured to swing the rack 290 for a dishwasher may be provided. The drive unit 620 may include a support 630 on which the rack 290 for a dishwasher is placed, a support rod 635 configured to support the support so as to be movable in a swing manner, and an actuator 640 configured to drive the support rod 630.

When the rack 290 for a dishwasher is placed onto the support 630 and the actuator 640 actuates the support rod 635, the support 630 may move about the support rod 635 in a swing manner. As a result, the roller 320 of the rack 290 for a dishwasher makes a relative moving about the support shaft 324 in a state of being in rolling contact with the upper surface of the support 630. Thus, a molecular binding of the fluoride 510 can be smoothly carried out in the interior of the support shaft hole 322. As a result, friction within the inside of the support shaft hole 322 may be reduced, and residual water of the washing water may be reduced.

In the foregoing, exemplary embodiments of the present invention have been shown and described. However, the present invention may be embodied in various forms without departing from the spirit or essential characteristics thereof, and accordingly, it is intended that the embodiment described above not be limited by the detailed description provided herein.

Moreover, even if any embodiment is not specifically disclosed in the foregoing detailed description, it should be broadly construed within the scope of the technical spirit, as defined in the accompanying claims. Furthermore, all modifications and variations included within the technical scope of the claims and their equivalents should be covered by the accompanying claims.

What is claimed is:

1. A rack for a dishwasher, the rack being disposed within a washing space of the dishwasher and configured to accommodate washing objects to be washed, the rack comprising:

a plastic member;

a fluorine-combined layer disposed on a surface of the plastic member by molecular binding of fluoride; and a roller configured to contact a supporting object of the dishwasher and roll on the supporting object, the roller comprising a roller body made of a plastic material, wherein the fluorine-combined layer is disposed on a surface of the roller body by molecular binding of fluoride, and wherein the roller defines a support shaft hole through which a support shaft of the rack is inserted, and the fluorine-combined layer is disposed inside the support shaft hole.

2. The rack of claim 1, wherein the plastic member comprises a rack body made of a plastic material, the rack body defining a storage space configured to accommodate the washing objects, and wherein the fluorine-combined layer is disposed on a surface of the rack body by molecular binding of fluoride.

3. The rack of claim 1, further comprising:

a rack body that defines a storage space configured to accommodate the washing objects; and a handle made of a plastic material and coupled to the rack body, the handle comprising a handle body made of the plastic material, and wherein the fluorine-combined layer is disposed on a surface of the rack body by molecular binding of fluoride.

4. A dishwasher comprising:

a dishwasher body that defines a washing space therein;

a door configured to open and close at least a portion of the washing space; and a rack disposed within the washing space and configured to accommodate washing objects to be washed, and wherein the rack comprises a plastic member and a fluorine-combined layer that is disposed on a surface of the plastic member by molecular binding of fluoride, wherein the rack comprises:

a rack body that defines a storage space configured to accommodate the washing objects, a handle made of a plastic material and coupled to the rack body, the handle comprising a handle body made of the plastic material, and a roller configured to contact a supporting object of the dishwasher and roll on the supporting object, the roller comprising a roller body made of a plastic material, wherein the fluorine-combined layer is disposed on each of a surface of the handle and a surface of the roller body by molecular binding of fluoride, and wherein the roller defines a support shaft hole through which a support shaft of the rack is inserted, and the fluorine-combined layer is disposed inside the support shaft hole.

5. The dishwasher of claim 4, wherein the fluorine-combined layer is disposed on a surface of the rack body by molecular binding of fluoride.

6. The dishwasher of claim 4, wherein the rack further comprises:

a cup rack disposed at an interior of the rack body, the cup rack comprising a cup rack body made of a plastic material and configured to support cups, and wherein the fluorine-combined layer is disposed on a surface of the cup rack body by molecular binding of fluoride.

7. The dishwasher of claim 4, wherein the rack further comprises a spoon basket disposed inside the rack body, wherein the spoon basket comprises a spoon basket body that is made of a plastic material and that defines an internal storage space therein, and wherein the fluorine-combined layer is disposed on a surface of the spoon basket body by molecular binding of fluoride.

8. The dishwasher of claim 4, wherein the roller body defines the support shaft hole.

9. The dishwasher of claim 4, wherein the rack further comprises:

an upper rack disposed at an upper portion of the dishwasher body, the handle being disposed at the upper rack; and a lower rack spaced apart from the upper rack and disposed at a lower portion of the dishwasher body.

10. The rack of claim 1, wherein the fluorine-combined layer disposed inside the support shaft hole is configured to contact an outer surface of the support shaft and to reduce friction between an inner surface of the support shaft hole and the outer surface of the support shaft.

11. The rack of claim 1, wherein the fluorine-combined layer disposed on the surface of the roller body is configured to contact the supporting object and to reduce friction between the roller body and the supporting object.

* * * * *